US008316600B2

(12) United States Patent
Wendt

(10) Patent No.: US 8,316,600 B2
(45) Date of Patent: Nov. 27, 2012

(54) WALL CONFORMING SUSPENDED CEILING MOLDING

(75) Inventor: Alan C. Wendt, Inverness, IL (US)

(73) Assignee: USG Interiors, LLC, Chicago, IL (US)

( * ) Notice: Subject to any disclaimer, the term of this patent is extended or adjusted under 35 U.S.C. 154(b) by 37 days.

(21) Appl. No.: 12/960,576

(22) Filed: Dec. 6, 2010

(65) Prior Publication Data

US 2012/0137614 A1 Jun. 7, 2012

(51) Int. Cl.
*E04B 2/00* (2006.01)

(52) U.S. Cl. ..... 52/288.1; 52/287.1; 52/716.8; 52/717.06

(58) Field of Classification Search ..... 52/287.1, 52/288.1, 716.8, 717.06
See application file for complete search history.

(56) References Cited

U.S. PATENT DOCUMENTS

| | | | | | |
|---|---|---|---|---|---|
| 2,585,727 | A | * | 2/1952 | Barton | 52/717.06 |
| 2,964,148 | A | * | 12/1960 | Jacobson | 52/281 |
| 3,159,251 | A | * | 12/1964 | Becker | 52/283 |
| 3,206,806 | A | * | 9/1965 | Powell | 52/287.1 |
| 3,225,503 | A | * | 12/1965 | Rallis | 52/506.08 |
| 3,238,685 | A | | 3/1966 | Emory | |
| 3,325,954 | A | * | 6/1967 | Olson | 52/302.1 |
| 3,867,802 | A | | 2/1975 | Murphy | |
| 4,197,686 | A | | 4/1980 | Baslow | |
| 4,283,891 | A | | 8/1981 | Moeller | |
| 4,406,104 | A | | 9/1983 | Beck et al. | |
| 4,598,516 | A | * | 7/1986 | Groshong | 52/241 |
| 4,982,540 | A | * | 1/1991 | Thompson | 52/288.1 |
| 4,991,373 | A | * | 2/1991 | Shaub | 52/715 |
| 5,081,812 | A | | 1/1992 | Reynolds | |
| 5,157,884 | A | * | 10/1992 | Schwartz | 52/506.06 |
| 5,243,797 | A | * | 9/1993 | Koenig, Jr. | 52/254 |
| 5,517,884 | A | | 5/1996 | Sanders | |
| 5,619,834 | A | | 4/1997 | Chen | |
| 5,724,784 | A | * | 3/1998 | Menchetti | 52/483.1 |
| 5,894,697 | A | * | 4/1999 | Hunter | 52/58 |
| 5,979,134 | A | | 11/1999 | Neff | |
| 6,637,172 | B2 | * | 10/2003 | Bousquet | 52/714 |
| D518,901 | S | | 4/2006 | Stackenwalt et al. | |
| 7,047,702 | B1 | * | 5/2006 | Callens et al. | 52/716.1 |
| 7,100,331 | B2 | * | 9/2006 | Nehring | 52/13 |
| 7,143,562 | B2 | | 12/2006 | Krantz-Lilienthal et al. | |
| 7,240,460 | B2 | * | 7/2007 | Platt | 52/506.07 |
| 7,278,243 | B2 | * | 10/2007 | Jones et al. | 52/506.07 |
| D574,520 | S | * | 8/2008 | Taylor et al. | D25/121 |
| 7,516,585 | B2 | * | 4/2009 | Lehane et al. | 52/506.07 |
| 2003/0131552 | A1 | * | 7/2003 | Leichtfried | 52/543 |
| 2006/0005493 | A1 | * | 1/2006 | Burns et al. | 52/506.01 |
| 2007/0113513 | A1 | * | 5/2007 | Wendt | 52/665 |
| 2008/0127585 | A1 | | 6/2008 | Ruhlmann et al. | |
| 2008/0245006 | A1 | * | 10/2008 | Rachak | 52/287.1 |
| 2008/0276560 | A1 | | 11/2008 | Labonte | |
| 2011/0078969 | A1 | * | 4/2011 | Tedesco et al. | 52/506.06 |

* cited by examiner

*Primary Examiner* — Brian Glessner
*Assistant Examiner* — Joshua Ihezie
(74) *Attorney, Agent, or Firm* — Pearne & Gordon LLP

(57) ABSTRACT

A wall molding for a suspended ceiling comprising a roll-formed sheet metal body having a generally upright component to be fixed to a wall and a projecting component extending generally transversely to the upright component and adapted to underlie and support the edges of ceiling tiles and ends of grid runners, the projecting component in a free state extending across a plane defined by the upright component to a line adapted to abut the wall when the upright component is drawn towards the wall.

6 Claims, 2 Drawing Sheets

WALL CONFORMING SUSPENDED CEILING MOLDING

BACKGROUND OF THE INVENTION

The invention relates to suspended ceiling systems and, in particular, to an improved wall molding for use in such systems.

PRIOR ART

Where a suspended ceiling meets a wall, it is customary to provide a sheet metal wall angle. This wall angle serves to support the edges of ceiling panels or tiles and the ends of grid runners and to conceal normal gaps between these edges and ends and the wall. Walls conventionally constructed of drywall are often not flat because of the presence of corner bead, taped joints, and other disturbances. These irregularities can be especially pronounced where a space is being remodeled and walls are reconfigured. Standard metal wall angles, while ordinarily made of light gauge steel, are relatively stiff owing to the right angle geometry. As a result, ordinary wall angle often does not closely follow the irregularities in a wall and unsightly gaps between the wall angle and the wall can exist. While it is customary to conceal such gaps with caulk, this technique is undesirable as a solution to the problem of unsightly gaps. Efforts to force the wall angle into full contact with an irregular wall surface can cause the wall angle to permanently buckle and present an even more unsightly condition.

SUMMARY OF THE INVENTION

The invention provides a wall molding for suspended ceiling systems that is capable of conforming to ordinary deviations from a flat plane in the surface of a wall against which it is mounted. The inventive wall angle, in various embodiments, has a visible wall engaging area that, in a free state, projects from an upright component of the molding toward the wall. When the upright component of the molding is drawn against the wall surface, the visible wall engaging area retracts towards a plane of the upright component. Where the upright component is not locally drawn against or close to the wall surface because adjacent wall areas bulge or recede from a flat plane, the retractable visible wall engaging area remains extended towards the wall. Consequently, unsightly gaps between the visible wall engaging area of the molding and the wall are avoided. Advantageously, the molding can be roll-formed of a single metal strip sufficiently hard or springy to allow the strip to resiliently flex and allow retraction of the visible wall engaging area or, if adjustment is needed, allow return of this area to its free state. In a first disclosed embodiment, a metal strip forming the molding body is folded in a manner such that the visible wall engaging area is formed along an edge of the strip that is opposite the edge on a side of the strip that projects to support ceiling panel edges and grid runner ends. When the upright component is drawn towards a wall during installation of the molding, the visible wall engaging area telescopes or slides under adjacent areas of the projecting component.

In a second disclosed embodiment, a metal strip forming the molding body is folded in a manner such that the visible wall engaging area is at an edge of the side of the strip that forms the projecting component. The visible wall engaging area is enabled to retract by resilient, generally imperceptible distortion of large portions of the cross-section of the molding.

DESCRIPTION OF THE PREFERRED EMBODIMENTS

Figures 1, 1A:
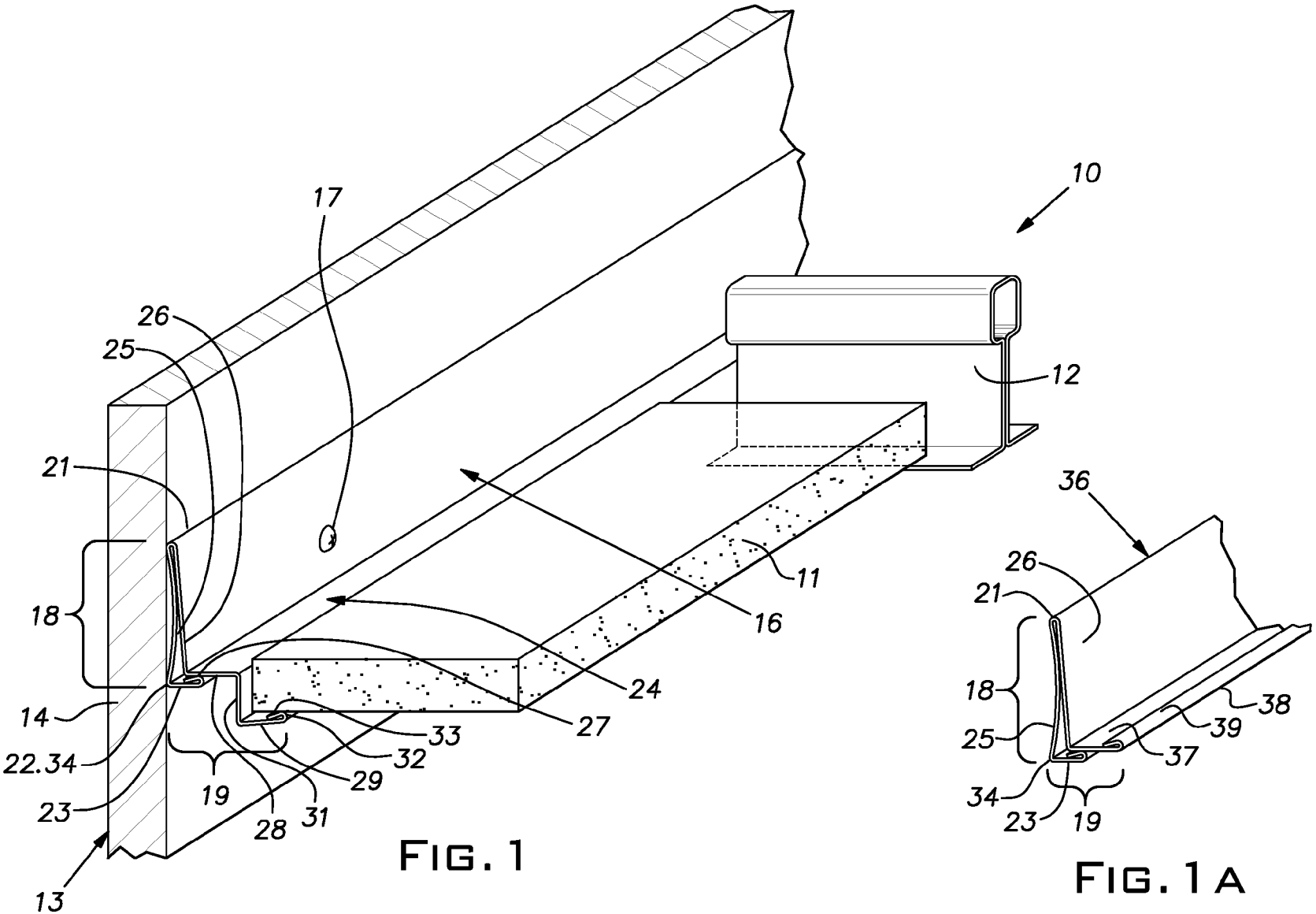
FIG. 1 is a fragmentary isometric view of a first embodiment of a wall molding of the invention.
FIG. 1A is a fragmentary isometric view of a modified form of the first embodiment of the inventive wall molding.

Referring now to FIG. 1, a suspended ceiling system 10 is represented by a ceiling panel or tile 11 and a grid runner or tee 12. The panel 11 and tee 12 can be standard commercially available products and, as is conventional, are duplicated across the expanse of a ceiling. FIG. 1 represents an edge of the ceiling system 10 where it intersects with a wall 13. The wall can be constructed of drywall sheets indicated at 14 secured to vertical studs (not shown) or other structure at the backside thereof.

Where drywall sheets 14 are joined, particularly where their ends are abutted and taped or where they intersect at an outside corner and are capped with a corner bead and joint compound, the wall will have localized bulges meaning that the wall surface deviates from a flat plane. A first embodiment of a wall molding 16 constructed in accordance with the invention is illustrated in FIG. 1. The molding 16 is secured to the wall 13 by fasteners 17 such as screws, nails, or staples. It is customary that the fasteners are driven through the drywall 14 into the underlying studs or other framework or support. Typically, the studs will be spaced horizontally a regular distance along the wall 13.

The wall molding 16 comprises a generally upright component 18 and a projecting component 19. The wall molding 16, preferably, is a single sheet of metal, typically steel sufficiently hard to exhibit a springiness or resilience as discussed below. The wall molding 16 while it can be brake-formed, is preferably roll-formed using conventional roll-forming techniques known in the industry. The upright component 18 comprises two layers 25, 26. The outer layer 26 can be flat, as shown, or can be convex on the side facing the wall 13. In the latter case, the plane of the upright component layer 26 can be taken as an imaginary plane, vertical or nearly vertical, that passes through its upper and lower extremities indicated at 21, 22, respectively.

The projecting component 19 of the molding 16 comprises first and second parts 23, 24. The wall molding 16 has a constant cross-section extending along its length. The length of the wall molding typically is 10' or 12' or metric equivalent. The first part 23 of the projecting component 19 is a relatively narrow horizontal flange carried at the bottom of the layer 25 made by folding the molding body on itself at the upper extremity 21 of the upright component. In the illustrated form of the wall molding 16, the layer 25 is concave on its side facing the wall 13. The first part 23 of the projecting component 19 exists along a side of the strip from which the wall molding 16 is made that is remote from the side of the strip forming the second part 24 of the projecting component 19. The free edge of the projecting component first part 23 is hemmed at 27 by folding the sheet material back on itself, the hem being on an upper side of this first part.

The projecting component second part 24, in the embodiment version of FIG. 1, is stepped such that it includes two horizontal segments 28, 29 joined by a vertical segment 31.

The horizontal segment 29 comprises one of the lateral or marginal sides of the strip forming the wall molding 16. A distal free edge 32 of the horizontal segment 29 is provided with a hem 33 folded back on its upper side.

The upright component 18 and the second part 24 of the projecting component 19 are relatively stiff in vertical and horizontal planes owing to their right angle character. This means that the upright component 18 and horizontal segment 28 will not readily follow the contour of the wall 13 where it deviates from a flat plane even when the fasteners 17 are forcibly urging the upright component towards the wall 13.

The forefront of FIG. 1 depicts a location on the wall that is recessed from an adjacent area or areas at the same elevation. That is, areas of the wall horizontally spaced from the plane of the forefront of FIG. 1 can be considered to be bulging as a result of, for example, a butt joint between sheets of drywall or a corner bead. Inspection of FIG. 1 shows that the gap at the surface of the wall 13 with the segment 26 forming part of the upright component 18 and the second part 24 of the projecting component 19 is concealed by the first part 23 of the projecting component 19 which engages the wall at a line 34 formed at a corner between the upright component layer 25 and the first part of the projection component. Where the wall is flat along an extended line or where a bulge occurs, a fastener 17 can draw the upright component layers 25 and 26 against one another and the layer 25 against the wall 13. When being drawn towards the wall, the layer 25 causes the first part 23 of the projecting component to telescope or slide under the horizontal segment 28 of the second part 24 of the projecting component 19. It will be seen that the molding 16 conforms to normally expected deviations in the flatness of the wall by concealing gaps which may result from such deviations since the projecting component first part 23 bridges a gap between the wall 13 and the relatively stiff generally right angular configuration of the upright component layer 26 and second part 24 of the projecting component 19. The edge view of the wall molding 16 shown in the forefront of FIG. 1, reveals the cross-sectional configuration of the wall molding 16 essentially in its free state. Ideally, the metal used to make the wall molding 16 is sufficiently hard or springy so that it will assume this free state configuration even after it has been tightened against a wall with a fastener and then released in case final adjustments need be made to optimize appearance.

FIG. 1A illustrates a wall molding 36 that is a variant of the wall molding 16. Elements of the wall molding 36 having the same or essentially the same function as that described in connection with the wall molding 16 of FIG. 1 are identified with the same numerals. The wall molding 36, as compared to the molding 16, has a projecting component second part 37 that is a simple horizontal segment terminated at a distal edge 38 with a hem 39 turned on its upper face. The wall molding 36 works in essentially the same way as the wall molding 16 to conceal gaps between the wall 13 and the upright component layer 26 and second part 37 of the projecting component 19.

Figures 2, 2A:
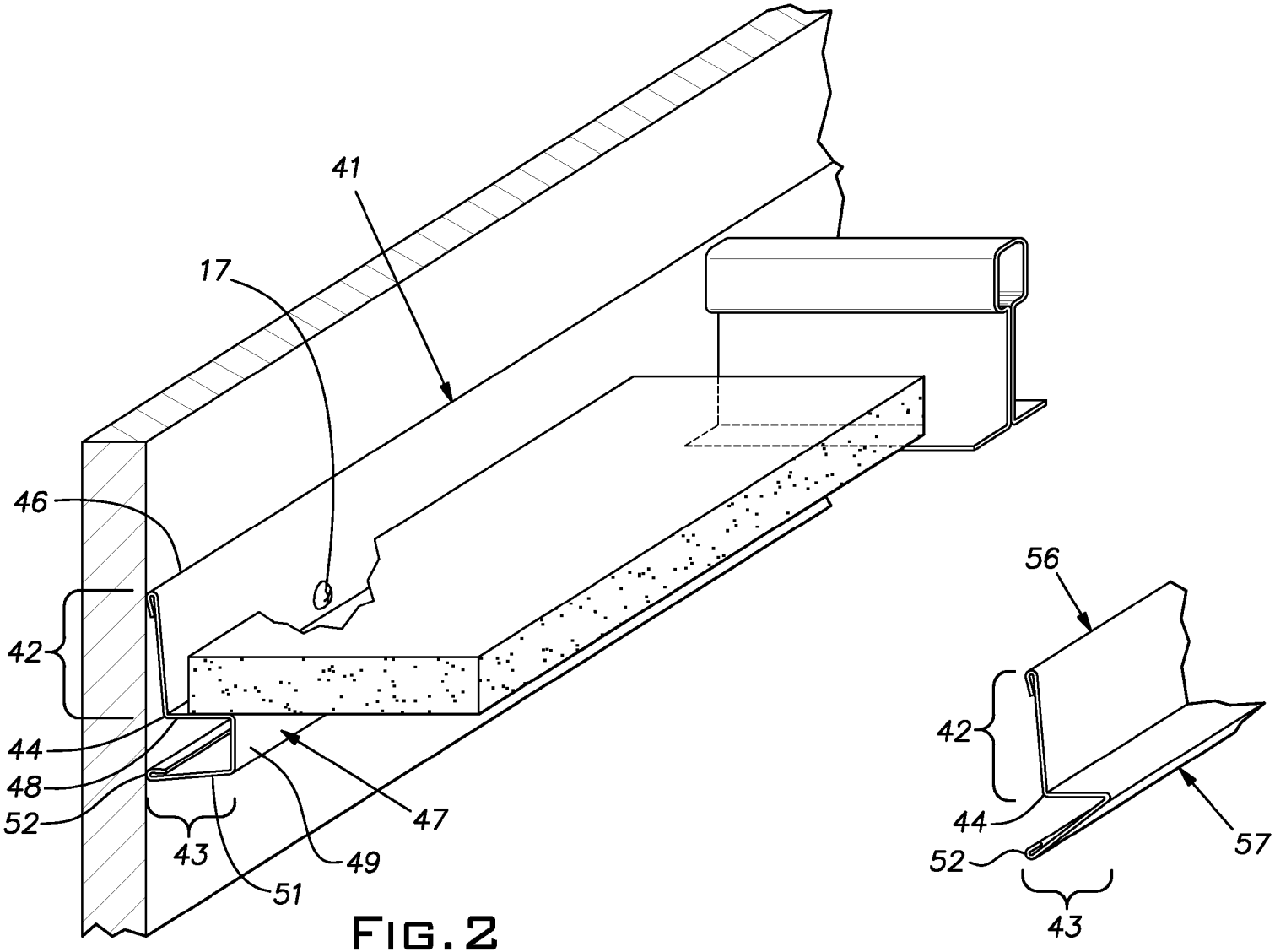
FIG. 2 is a fragmentary isometric view of a second embodiment of a wall molding of the invention.
FIG. 2A is a fragmentary isometric view of a modified form of the second embodiment of the inventive wall molding.

Referring now to FIG. 2, there is shown a second embodiment of a wall molding 41. Identical or similar elements to that described in connection with FIG. 1 are identified with the same numerals in FIG. 2. The wall molding 41 as in the previous wall moldings 16, 36 is preferably roll-formed of half hard sheet steel of light gauge. The free state cross section of the wall molding 41 is illustrated in the foreground of FIG. 2 and is continuous along its length which, again, can be in the order of 10' or 12' or metric equivalent. The wall molding has an upright component 42 and a projecting component 43. The upright component 42 is generally planar extending upwards from a corner 44 it shares with the projecting component to an upper hemmed edge 46.

The projecting component 43 comprises a C-shaped channel 47 comprising an upper horizontal segment 48, a generally vertical segment 49, and a lower generally horizontal segment 51.

The lower segment 51 is somewhat longer than the upper horizontal segment 48. The result of this geometry, as depicted in FIG. 2, is that a free edge 52 of the lower horizontal segment 51 extends inward toward the wall 13 beyond a plane in which the upright component 42 lies. The generally right angle configuration at the corner 44 of the upright component 42 and the projection component horizontal segment 48 is relatively stiff so that a gap between this corner 44 and the wall 13 can exist where the wall is uneven. However, the inherent flexibility of the cross-section of the wall molding other than about a vertical axis will allow the free edge or line 52 to extend to the surface of the wall 13 even where a gap exists between the corner 44 and the wall. When the wall is sufficiently flat the fasteners 17 draw the upright component 42 against the wall 13. The fastener 17 can be adjusted to accommodate variations in the wall plane. The free edge 52, owing to the resilient compliance of the wall molding 41 through local, essentially imperceptible distortion of the wall molding cross-section can retract towards the plane of the upright component 42. Otherwise, the gap between the corner 44 and wall 13 would be visible.

Referring now to FIG. 2A, a modified form of the second embodiment of the inventive wall molding is shown at 56. The same numerals are used in FIG. 2A as that used in 2 for components of the wall moldings 41 and 56 that are the same or equivalent. The wall molding 56 has a projecting component 43 comprised of a V-shaped channel 57. The wall molding cross-section in its free state is shown at the forefront of FIG. 2A. It will be seen that the free edge 52 extends inward of the plane of the upright component 42 so that the wall molding 56 performs essentially the same way as the wall molding 41 in conforming to the contour of a wall and concealing any gap that may exist between the corner 44 and the wall where normal irregularities in the wall may exist.

Common among the various disclosed embodiments of the wall molding is that the visible wall engaging part, in the free state and proper orientation, extends inwardly in the direction of the wall beyond the plane of at least one layer of an upright component.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A wall molding for a suspended ceiling comprising a roll-formed sheet metal body, the body having a generally upright component adapted to be fixed to a wall by fasteners and a projecting component extending generally transversely to the upright component and adapted to underlie and support the edges of ceiling tiles and ends of grid runners, the projecting component having two telescoping parts that in a free state extend across a plane defined by the projecting component and when the upright component is drawn towards a surface of the wall by a fastener, the projecting component is capable by resilient deflection of the body of the molding of relative motion of one of said parts towards the plane of the upright component whereby the projecting component is adapted to abut the wall and conform to deviations of the wall surface from a true flat plane and avoid unsightly gaps between the projecting component and the wall surface; wherein said body is formed from a single strip of metal, and wherein a first part of the projecting component abuts a wall, and a second part of the projecting component underlies and supports the tile edges and ends of grid runners, the first part underlying the second part.

2. A wall molding as set forth in claim 1, wherein the first part depends from the upright component.

3. A wall molding as set forth in claim 2, wherein the first part terminates at an edge of the strip.

4. A wall molding as set forth in claim 3, wherein the edge comprises a hem turned above a main section of the first part.

5. A wall molding as set forth in claim 1, wherein the metal strip forming the body has longitudinal edges, the edges each having an in-turned hem.

6. A wall molding as set forth in claim 1, wherein a layer of the upright component is concave facing the wall surface.

* * * * *